US006561508B2

(12) United States Patent
Helmstädter et al.

(10) Patent No.: US 6,561,508 B2
(45) Date of Patent: May 13, 2003

(54) DEVICE AND METHOD FOR TRANSFERRING A SHEET

(75) Inventors: Karl-Heinz Helmstädter, Heidelberg (DE); Raimund Schröder, Hockenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 134 days.

(21) Appl. No.: 09/789,793

(22) Filed: Feb. 20, 2001

(65) Prior Publication Data

US 2001/0015523 A1 Aug. 23, 2001

(30) Foreign Application Priority Data

Feb. 18, 2000 (DE) ..... 100 07 596

(51) Int. Cl.[7] ..... B65H 9/00
(52) U.S. Cl. ..... 271/226
(58) Field of Search ..... 271/226, 276, 271/309, 195, 314, 900; 198/470.1, 407, 408, 409, 803.3; 101/240

(56) References Cited

U.S. PATENT DOCUMENTS 4,395,949 A * 8/1983 Jeschke ..... 101/231
5,979,318 A * 11/1999 Helmstadter ..... 101/232

FOREIGN PATENT DOCUMENTS

| | | | |
|---|---|---|---|
| DE | 94 11 462.5 | 10/1994 | |
| DE | 43 18 777 C2 | 12/1994 | |
| DE | 44 24 968 C2 | 1/1996 | |
| DE | 195 16 374 A1 | 11/1996 | |
| DE | 195 47 580 A1 | 6/1997 | |
| EP | 0 197 802 | * 11/1985 | ..... B41F/21/00 |
| EP | 0 306 682 A2 | 3/1989 | |

* cited by examiner

*Primary Examiner*—Donald P. Walsh
*Assistant Examiner*—Kenneth W Bower
(74) *Attorney, Agent, or Firm*—Laurence A. Greenberg; Werner H. Stemer; Ralph E. Locher

(57) ABSTRACT

A device for transferring a sheet via a peripheral region of a cylinder includes an airflow-generating device for applying at least one air flow to the peripheral region of the cylinder, with which the sheet is associated, the airflow being directed in a direction of rotation of the cylinder; and a method of operating the device for transferring a sheet via a peripheral region of a cylinder.

11 Claims, 4 Drawing Sheets

DEVICE AND METHOD FOR TRANSFERRING A SHEET

BACKGROUND OF THE INVENTION

Field of the Invention

The invention relates to a device for transferring a sheet via a peripheral region or area of a cylinder, which includes an airflow generator for applying an airflow onto the sheet-carrying peripheral region of the cylinder, and to a method of transferring a sheet via a peripheral region of a first cylinder and for feeding the sheet in an exact position to a second cylinder disposed downline from the first cylinder, wherein at least one airflow is directed onto the sheet lying on the peripheral region of the cylinder.

Such devices and methods of transferring a sheet have become known heretofore from, for example, the published German Patent Document DE 195 47 580 A1. The transfer device is installed in a sheet-fed printing machine, which can be operated in recto printing or in recto/verso or perfector printing and serves for transferring sheets from a first sheet-guiding cylinder to a third sheet-guiding cylinder in exact register. This is realized with the aid of a peripheral region of a cylinder which, in this connection, is also designated as a storage drum. It has been shown that, at high printing throughputs, i.e., at a high machine speed, the sheet engaging the periphery of the cylinder begins to have waves formed therein, which impairs in-register sheet guidance. The cause thereof is both centrifugal force acting upon the sheet, as well as a negative pressure zone which forms over the sheet because of the relative speed between the rotating cylinder and the stationary ambient air. In order to avoid this disadvantage, in heretofore known transfer devices, an airflow directed counter to the direction of rotation of the cylinder is blown onto the peripheral region of the cylinder presenting the sheet, and thus spreads out smoothly on the cylinder the sheet that has become deformed with the waves. It has been shown, that even through this measure, smooth contact between the sheet and the cylinder cannot always be assured.

SUMMARY OF THE INVENTION

It is therefore an object of the invention to provide a sheet transfer device and a method for transferring a sheet of the type referred to in the introduction hereto wherein smooth contact between the sheet and the peripheral region of the cylinder is assured, in particular, even at high machine speeds.

With the foregoing and other objects in view, there is provided, in accordance with one aspect of the invention, a device for transferring a sheet via a peripheral region of a cylinder, comprising an airflow-generating device for applying at least one airflow to the peripheral region of the cylinder, with which the sheet is associated, the airflow being directed in a direction of rotation of the cylinder.

In accordance with another feature of the invention, the airflow has a speed which is at most as great as the speed of the sheet.

In accordance with a further feature of the invention, the airflow is inclined with respect to an imaginary tangent to the periphery of the cylinder at an angle $0° \leqq \alpha < 90°$, the tangent intersecting a point of impingement of a central flow line of the airflow.

In accordance with an added feature of the invention, the airflow-generating device serves for producing compressed air or blast air.

In accordance with an additional feature of the invention, the airflow-generating device is assigned to an air guide device for aligning the airflow.

In accordance with yet another feature of the invention, the air guide device has at least one blast box formed with at least one air outlet opening.

In accordance with an alternative feature of the invention, the air guide device has at least one blast tube formed with at least one air outlet opening.

In accordance with another alternative feature of the invention, the air guide device has at least one blast box and at least one blast tube, respectively, formed with at least one air outlet opening.

In accordance with yet a further feature of the invention, the cylinder is formed of a storage drum of a reversing or turning device of a sheet-fed rotary printing machine.

In accordance with yet an added feature of the invention, the storage drum has at least one holding device for the sheets, and preferably at least one holding device for the leading edge or at least one holding device for the trailing edge of the respective sheets.

In accordance with yet an additional feature of the invention, the storage drum has a first holding device for a leading edge of the respective sheets, and a second holding device for a trailing edge of the respective sheets.

In accordance with a concomitant aspect of the invention, there is provided a method of transferring a sheet via a peripheral region of a first cylinder, and of feeding the sheet in an exact position to a second cylinder disposed downline of the first cylinder, wherein at least one airflow is directed onto the sheet lying on a peripheral region of the cylinder, which comprises directing the airflow in the direction of rotation of the cylinder, and preferably directing the airflow onto the sheet from a transfer device.

In order to achieve the objective of the invention, a transfer device is provided which includes a cylinder to which an airflow-generating device has been assigned, by the aid of which at least one airflow can be applied to a peripheral region of the cylinder on which the sheet to be transferred is disposed. The transfer device is distinguished by the fact that the airflow is directed in the direction of rotation of the cylinder. Due to this measure, it is possible to ensure that the air located over the sheet lying on the periphery of the cylinder moves in the same direction as the sheet. Due to the reduced differential speed between the sheet and the air located above it, the pressure in the negative pressure zone formed by the relative speed between sheet and air is so great that smooth contact between the sheet and the periphery of the cylinder can be realized.

In an advantageous exemplary embodiment of the transfer device, the velocity of the airflow is the same as the speed of the sheet resting on the periphery of the cylinder. The differential speed between the airflow and the sheet is therefore zero, i.e., the airflow over the sheet is at rest relative to the sheet, so that no negative pressure zone forms over the sheet. While in heretofore known transfer devices attempts have been made to weaken the negative pressure arising from the relative speed between the sheet and the air located above it, in the transfer device according to the invention, the cause itself of a negative pressure zone arising over the sheet is removed, so that no negative pressure zone can form at all, or the negative pressure in the negative pressure zone is so low that lifting of the sheet or wavy contact of the sheet with the periphery of the cylinder is avoided.

The transfer device can be used in an advantageous way in a sheet-fed rotary printing machine for transferring sheets from a guide cylinder to a turning or reversing drum, where in-register sheet guidance is required in order to avoid rejects. In this exemplary embodiment, the cylinder is formed of a storage drum disposed in the region between the guide cylinder and the turning or reversing drum.

In a preferred embodiment, the air flow is inclined with respect to an imaginary tangent to the periphery of the cylinder at an angle $\alpha$, which is greater than or equal to 0° and less than 90°, the tangent intersecting the point of impingement of a central flow line of the airflow. The airflow is therefore aligned in such a way that it strikes a sheet resting on the periphery of the cylinder at an acute angle or, in the case of an angle $\alpha$ equal to 0°, is directed parallel to the direction of displacement of the sheet in the region of the point of impingement in the direction of rotation of the cylinder.

In one exemplary embodiment of the transfer device, the invention provides for the airflow-generating device to generate compressed air or blast air. The velocity of the at least one airflow directed in the direction of rotation of the cylinder can preferably be matched to the travel speed and the material of the sheets, it being possible to realize higher velocities of the airflow with compressed air than with blast air.

A further development of the invention provides for the airflow-generating device to be associated with an air guide device which aligns the airflow. The airflow-generating device, which can be formed, for example, by a fan, a compressor or the like, therefore does not apply the compressed air or blast air directly to the sheet, but supplies it to the air guide device. The airflow can thereby be deflected precisely to a desired point on the peripheral region of the cylinder.

In a preferred embodiment, the air guide device has at least one blast box with one or more air outlet openings and/or at least one blast tube with at least one air outlet opening. The air outlet opening can be circular or slot-like. In an advantageous exemplary embodiment, the blast box/the blast tube extends over the entire length of the cylinder, so that the sheet can have applied thereto over the entire width thereof at least one airflow directed in the direction of rotation of the cylinder. Of course, it is also possible for a number of blast boxes and/or blast tubes to be arranged one after another, as viewed in the longitudinal direction of the cylinder, it being possible for the outlet openings thereof to be both circular and slot-like.

In order to achieve the objective, a method is also proposed. In the method, in order to transfer a sheet with the aid of a peripheral region of a first cylinder, and to feed the sheet in an exact position to a second cylinder arranged downline of the first cylinder, at least one airflow is directed onto that part of the peripheral region of the cylinder whereon the sheet is arranged. The method is distinguished by the fact that the air flow is directed in the direction of rotation of the cylinder. As a result, by comparison with heretofore known transfer devices, a lower differential speed between the sheet resting on the cylinder and the air located above it can be ensured, so that the negative pressure zone produced over the sheet by the only small relative speed between sheet and air is at least only so low that the formation of waves or creases in the sheet can be ruled out, and smooth contact between the sheet and the cylinder can be assured. In an advantageous embodiment, the velocity of the airflow and the speed of the sheet arranged on the peripheral region of the cylinder are equal, so that the formation of a negative pressure zone over the sheet can be prevented.

Other features which are considered as characteristic for the invention are set forth in the appended claims.

Although the invention is illustrated and described herein as a device and method for transferring a sheet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

The device 1 described hereinbelow can generally be used to transfer sheets, for example, paper or cardboard sheets. Purely by way of example, it will be assumed hereinbelow that the transfer device 1 is used in a sheet-fed rotary printing machine which can be operated in recto printing and/or in recto/verso or perfector printing.

Figure 1:
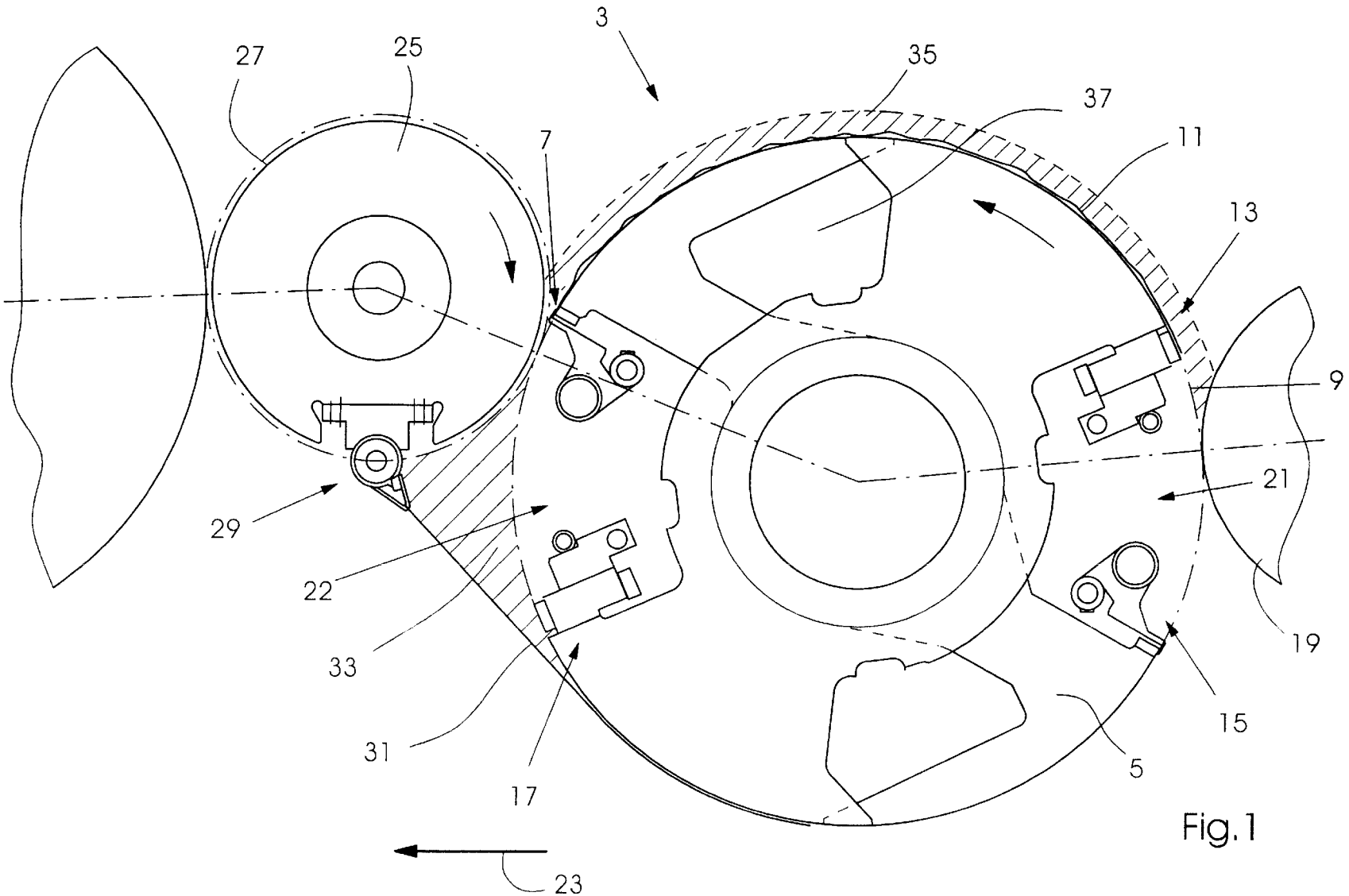
FIG. 1 is a fragmentary side elevational view of an exemplary embodiment of a sheet transfer device according to the invention.

Referring now more specifically to the drawings and, first, particularly to FIG. 1 thereof, there is shown therein, in a side elevational view, an exemplary embodiment of a reversing or turning device 3 serving for turning or reversing sheets in the sheet-fed rotary printing machine, which is otherwise not specifically illustrated. The reversing device 3 includes a storage drum 5, which has a first holding device 7 for the leading edge of a sheet 11, as viewed in the direction of rotation of the storage drum 5, the sheet 11 engaging with the outer peripheral or jacket face 9 of the storage drum 5. The storage drum 5 also has a second holding device 13 for the trailing edge of the sheet 11. Also provided is a third holding device 15 for the leading edge and a fourth holding device 17 for the trailing edge of a following sheet, which is brought up by a guide cylinder 19 disposed upline of the storage drum 5.

The second holding device 13 and the third holding device 15, as viewed in the peripheral direction of the storage drum 5, are arranged at a distance from one another in a first recess 21 formed in the outer jacket surface 9 of the storage drum 5, the recess 21 being open at the marginal edge thereof.

The first holding device 7 and the fourth holding device 17 are arranged in a second recess 22 disposed diametrically opposite the first recess 21. The recesses 21 and 22 extend at least approximately over the entire length of the storage drum 5. The first and third holding devices 7 and 15 are formed in this embodiment as clamping devices, each of which having a number of grippers which are arranged at a spaced distance from one another and, as viewed in the longitudinal direction of the storage drum 5, behind one another, the grippers holding the respective sheet in the leading-edge region thereof and fixing the sheet exactly in position on the outer jacket surface 9 of the storage drum 5. The second and fourth holding devices 13 and 17 are formed, in this embodiment, as suction devices, each of which has at least one sucker, and preferably a number of suckers arranged at a distance from one another and, as viewed in the longitudinal direction of the storage drum 5, disposed behind one another, the respective sheet being able to be held securely by the suckers in the trailing-edge region of the sheet. The second and fourth holding devices 13 and 17 hold the respective sheet in tension on the storage drum 5, even at high machine speeds, so that an in-register transfer, i.e., in an exact position, of the respective sheet to a turning or reversing drum 25 disposed downline of the storage drum 5, as viewed in the travel direction of the sheets represented by the arrow 23, can be assured.

The storage drum 5, on which two sheets can be stored in this exemplary embodiment, is of bipartite construction, the two halves of the drum being constructed like combs with interengaging prongs, so that an adjustment of the length of the sheets is possible by varying the distance between the holding devices 7 and 13, on the one hand, and the holding devices 15 and 17, on the other hand, respectively associated with a sheet being changed. The two halves of the drum are preferably of exactly identical construction and have a precisely ground outer jacket surface.

The spaced distance of the turning or reversing drum 25 from the storage drum 5 is chosen so that an outer jacket surface 27 of the turning or reversing drum 25 and the outer jacket surface 9 of the storage drum 5 are disposed at a very short distance from one another. The turning or reversing drum 25 has a clamping device 29 for the trailing edge of the sheet which is to be reversed or turned and is stored on the storage drum 5 and, in this exemplary embodiment, the clamping device 29 has a number of grippers arranged at a distance from one another and, as viewed in the longitudinal direction of the turning or reversing drum 25, disposed behind one another. The construction and the function of the clamping device 29 have become known heretofore, so that they will not be discussed specifically herein. In the functional position illustrated in FIG. 1, the clamping device 29 has gripped the trailing edge of a sheet 31, which has already separated considerably from the outer jacket surface 9 of the storage drum 5. Starting at a specific rotational position of the turning or reversing drum 25, the trailing edge of the sheet 31 becomes the leading edge.

Due to the separation of the sheet 31 from the outer jacket surface 9 of the storage drum 5 and the entrainment thereof by the turning or reversing drum 25, i.e., as the sheet 31 moves away from the storage drum 5, there is formed, between that side of the sheet 31 which faces the storage drum 5, the turning or reversing drum 25 and the storage drum 5, a region 33 wherein there is a negative pressure, because of the air entrained by the sheet. This negative pressure acts upon the following sheet 11 which is still resting on the storage drum 5 and which, under certain circumstances, can consequently be lifted off the outer jacket surface 9 of the storage drum 5, thereby possibly having a detrimental effect upon the in-register transfer of the sheet to the turning or reversing drum 25.

Figure 2:
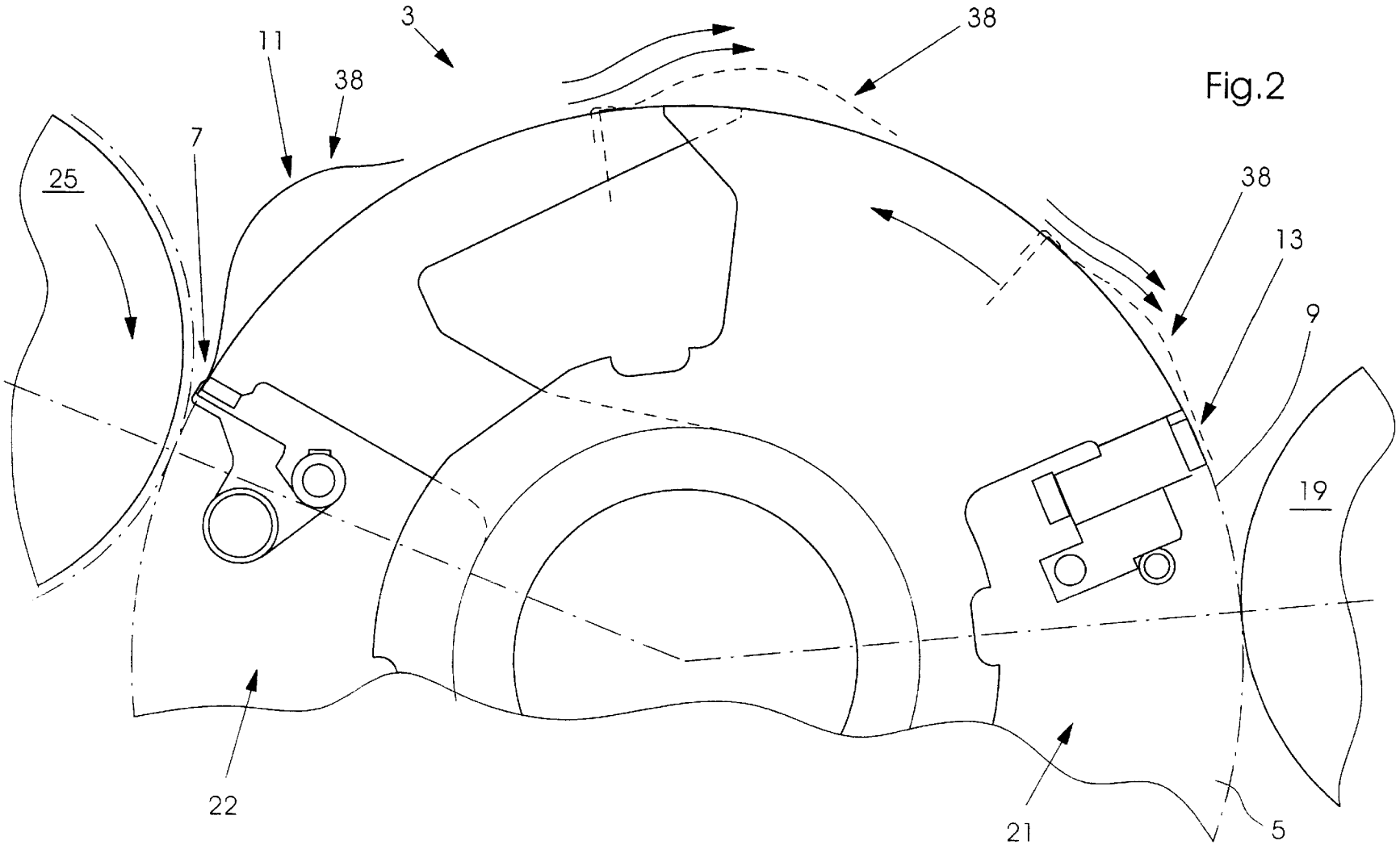
FIG. 2 is an enlarged fragmentary view of FIG. 1 showing in greater detail the operation of a reversing or turning device according to the invention.

During the transfer of the respective sheet from the guide cylinder 19 to the turning or reversing drum 25 with the aid of a peripheral region of the storage drum 5, in particular for high printing throughputs, i.e., at a high machine speed, a negative pressure zone 35, shown hatched in FIG. 1, is formed over the sheet at, amongst others, the peripheral region of the storage drum 5 at which the sheet is resting on the jacket of the storage drum 5. As FIG. 1 reveals, the negative pressure zone 35 extends from the nip between the guide cylinder 19 and the storage drum 5 until upline of the nip between the turning or reversing drum 25 and the storage drum 5. The negative pressure zone 35 is formed due to the difference in speed between the virtually stationary ambient air and the outer jacket surface 9 of the storage drum 5, which is moving at high speed. The negative pressure acting over the sheet 11 resting on the outer jacket surface 9 causes the sheet 11, as illustrated in FIG. 1, to rest in a wavy form on the storage drum 5 and, as illustrated in FIG. 2, the waves formed in the sheet continue to increase, respectively, which makes it impossible to provide in-register sheet guidance. It is in particular the flow over the wavy sheet that results in the formation of the negative pressure zone 35. Centrifugal force acting upon the sheet to be transferred further promotes local lifting of the sheet from the storage drum 5. The lifting of the sheet is possible, in particular, because the trailing edge thereof is gripped only by the suckers when the trailing edge passes the nip formed between the storage drum 5 and the guide cylinder 19. Therefore, while a negative pressure exists over the sheet resting on the storage drum 5, in this exemplary embodiment of the storage drum 5, positive pressure is present in free spaces or clearances between the prongs of the storage drum 5, of which only the clearance 37 is identified in FIG. 1, because of the centrifugal force acting upon the air particles in the clearances, and the positive pressure acts upon the underside of the sheet and likewise contributes to the lifting of the sheet.

FIG. 2 is a detailed illustration of the storage drum 5 of FIG. 1 on an enlarged scale. Identical parts are provided with the same reference numerals, so that, to this extent, reference is made to the foregoing description of FIG. 1. FIG. 2 reveals the sheet 11 which, following the transfer from the guide cylinder 19 to the storage drum 5, does not rest smoothly on the outer jacket surface 9 of the storage drum 5, but exhibits a relatively small wave 38 therein. Because of the ambient airflow over the wave 38, as represented by the associated arrows, the formation of the negative pressure on the outer jacket surface 9 of the storage drum 5 is reinforced, resulting in a continuous increase in the size of the wave 38 during the transport thereof towards the turning or reversing drum 25, i.e., the wave formed in the sheet becomes increasingly higher.

Hereinafter, a respective exemplary embodiment of the transfer device 1 according to the invention is described in greater detail with reference to FIGS. 3 and 4. Parts which are illustrated in FIG. 1 and have already been described with reference to FIG. 1 are provided with the same reference numerals, so that, to this extent, reference is made to the description of FIG. 1.

Figure 3:
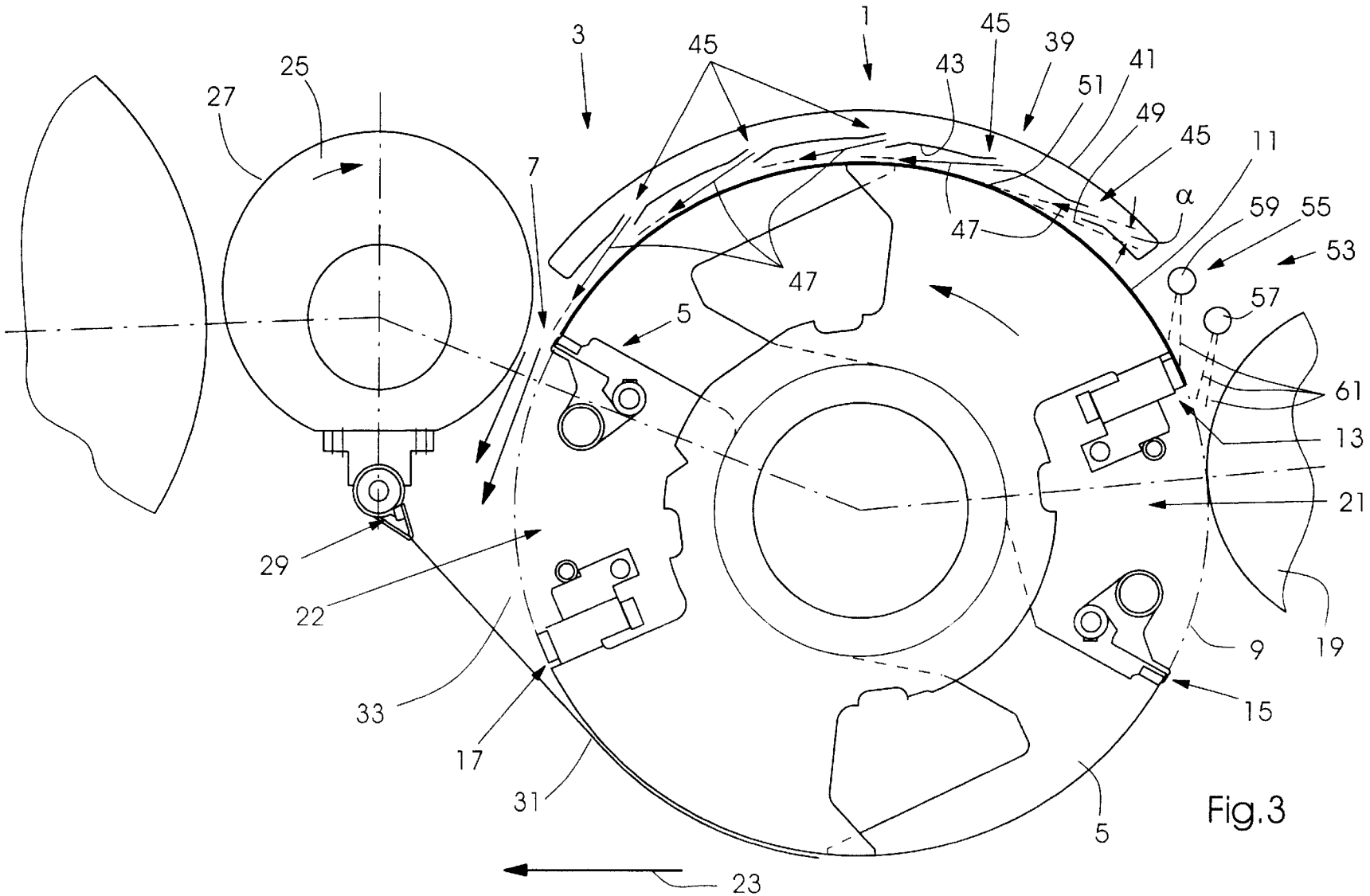
FIGS. 3 and 4 are views like that of FIG. 1 of other exemplary embodiments of the transfer device according to the invention.

FIG. 3 is a side elevational view of the transfer device 1 serving to transfer a sheet from the guide cylinder 19 to the turning or reversing drum 25 with the aid of a peripheral region of a cylinder in the form of the storage drum 5 in this figure. The transfer device 1 includes an air guide device 39 which has a blast box 41 spaced a slight distance from and above the storage drum 5. The blast box 41 preferably extends over the entire length and over a peripheral region of the storage drum 5, the blast box 41, in this exemplary embodiment, having a length that is smaller than the length of the sheet 11. The blast box 41 is matched to the outer contour of the storage drum 5, so that a bottom wall 43 of the blast box 41, facing the storage drum 5, is curved in such a manner that the height of the gap between the blast box 41 and the storage drum 5 is virtually constant.

The blast box 41 is connected to an airflow-generating device, which is not illustrated in FIG. 3, for example, a fan or a compressor, and is provided with a number of air outlet openings 45 which are formed in the bottom wall 43. The air outlet openings 45 are preferably slot-shaped and are arranged in series or behind one another over the periphery of the storage drum 5, i.e., the air outlet openings 45 extend virtually over the entire length of the blast box 41. The air outlet openings 45 are arranged and shaped, respectively, so that the respective airflow 47 emerging therefrom, represented by a respective arrow in FIG. 3, is directed in the direction of rotation of the storage drum 5. The velocity of the airflows 47 is preferably the same as the peripheral speed of the storage drum 5 and/or the speed of the sheet 11 held on the outer jacket surface 9. The differential speed between the sheet 11 resting on the storage drum 5 and the air located thereabove is therefore equal to zero in this case, so that no negative pressure zone 35, as was explained with reference to FIG. 1, can form. By applying blast air or compressed air directed in the direction of rotation of the storage drum 5, a smooth, i.e., crease-free and wave-free contact between the sheet and the outer jacket surface 9 of the storage drum 5 can be assured, so that in-register transfer of the sheet to the next following turning or reversing drum 25 is possible.

In another exemplary embodiment of the transfer device 1, the velocity of the air flow 47 emerging from the air outlet opening 45 is lower than the speed of the sheet, which leads to the possibility of a negative pressure zone forming over the sheet resting on the storage drum 5, as was explained, for example, with reference to FIG. 1, but the negative pressure being only so high that smooth contact between the sheet and the outer jacket surface 9 of the storage drum 5 can be assured.

The airflow emerging from the air outlet opening 45 in the direction of the storage drum 5 is aligned so that, with respect to the outer jacket surface 9 of the storage drum 5, the airflow is inclined to an imaginary tangent line 49, shown as a broken line, at an angle $\alpha$, which can be less than 90° and greater than or equal to 0° and which is about 10° in the embodiment of FIG. 3. The tangent 49 intersects an impingement point 51 of a central flow line of the airflow. By "central flow line" there is meant a partial air jet located at the center of the airflow.

In the exemplary embodiment illustrated in FIG. 3, a blaster or blower device 55 is arranged in a clearance 53 between the blast box 41 and the nip formed between the guide cylinder 19 and the storage drum 5, said blaster device having two blast tubes 57 and 59 which are arranged serially or behind one another in the peripheral direction of the storage drum 5 and, respectively, having at least one non-illustrated air outlet opening. The blast tubes 57 and 59 are connected to a non-illustrated compressed-air or blast-air generating device, so that airflows 61, represented by broken lines, can be blasted or blown in a direction counter to the direction of rotation of the storage drum 5, for the purpose of ensuring smooth contact between the trailing edge of the sheet and the storage drum 5, so that the sheet can be tensioned in the longitudinal direction thereof.

Figure 4:
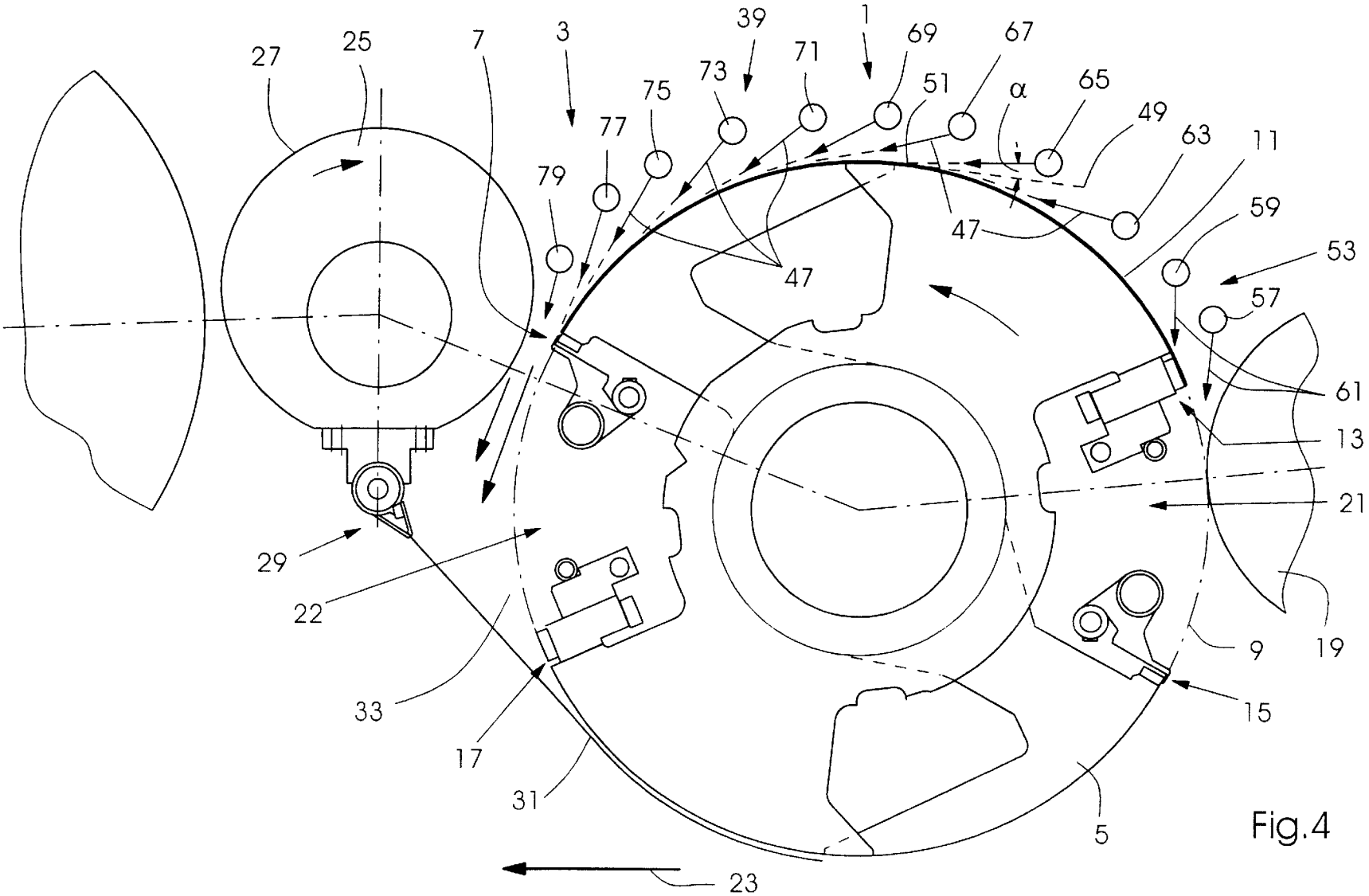

FIG. 4 shows a further exemplary embodiment of the transfer device 1, having the air guide device 39 with blast tubes 63 to 79, which are arranged serially or behind one another in the peripheral direction of the storage drum 5 and on an imaginary circular line having a center coinciding with the center of the storage drum 5. The blast tubes 63 to 79, which are arranged above the storage drum 5 and at a spaced distance from the latter, are, respectively, formed with at least one air outlet opening, which is not illustrated in FIG. 4 but preferably extends over the entire length of the respective blast tube. From the air outlet openings of the blast tubes 63 to 79, which are connected to an airflow-generating device, respective airflows 47 are directed in the direction of rotation of the storage drum 5 onto the peripheral region of the storage drum 5 whereon the sheet to be transferred can be applied.

In this exemplary embodiment also, the airflow 47 emerging from the blast tubes 63 to 79 is inclined with respect to a tangent 49 intersecting the point of impingement 51 of the air flow 47 on the storage drum 5 at an angle $\alpha$, which can be greater than or equal to 0° and less than 90°. Also, in the exemplary embodiment illustrated in FIG. 3, assuming an appropriate velocity of the airflows 47 directed onto the outer jacket surface 9, the formation of a negative pressure zone over the sheets as a result of a relative movement between the ambient air and the sheet held on a peripheral region of the storage drum 5 can be counteracted, so that in-register transfer of the sheet to the turning or reversing drum 25 can be assured.

In the exemplary embodiment of the transfer device 1 illustrated in FIG. 4, the peripheral region of the storage drum 5, by the aid of which the sheet 11 is transferred to the turning or reversing drum, 25 is not completely covered by the air guide device 39 having the blast tubes 63 to 79, as in the case of the blast box 41 described with reference to FIG. 2. Nevertheless, the air over the sheet 11 held on the peripheral region of the storage drum 5 can be moved at the desired velocity in the peripheral direction of the storage drum 5 with the aid of the blast tubes 63 to 79.

A factor which is common to the transfer devices 1 described with reference to FIGS. 3 and 4 is that the airflows 47 applied to the peripheral region of the storage drum 5 having the sheet thereon, with the aid of the blast box 41 and/or the blast tubes 63 to 79, also contribute to dissipating the negative pressure, which forms as a sheet is turned or reversed, in the region 33 bounded by the sheet to be turned or reversed, the turning or reversing drum 25 and the storage drum 5, because the additional air from the air guide device 39 is able to flow in through the nip formed between the storage drum 5 and the turning or reversing drum 25 and into the region 33 located thereunder.

We claim:

1. A device for transferring a sheet via a peripheral region of a cylinder, comprising:

an airflow-generating device for applying at least one airflow to the peripheral region of the cylinder, with which the sheet is associated, said airflow being directed in a direction of rotation of the cylinder; and an air guide device for aligning said airflow, said airflow-generating device being assigned to said air guide device.

2. The transfer device according to claim 1, wherein said airflow has a speed which is at most as great as the speed of the sheet.

3. The transfer device according to claim 1, wherein said airflow is inclined with respect to an imaginary tangent to the periphery of the cylinder at an angle $0° \leqq \alpha < 90°$, said tangent intersecting a point of impingement of a central flow line of said airflow.

4. The transfer device according to claim 1, wherein said airflow-generating device serves for producing one of compressed air and blast air.

5. The transfer device according to claim 1, wherein said air guide device has at least one blast box formed with at least one air outlet opening.

6. The transfer device according to claim 1, wherein said air guide device has at least one blast tube formed with at least one air outlet opening.

7. The transfer device according to claim 1, wherein said air guide device has at least one blast box and at least one blast tube, respectively, formed with at least one air outlet opening.

8. The transfer device according to claim 1, wherein the cylinder is formed of a storage drum of a reversing or turning device of a sheet-fed rotary printing machine.

9. The transfer device according to claim 8, wherein said storage drum has at least one holding device for the sheets.

10. The transfer device according to claim 8, wherein said storage drum has a first holding device for a leading edge of the respective sheets, and a second holding device for a trailing edge of the respective sheets.

11. A method of transferring a sheet via a peripheral region of a first cylinder, and of feeding the sheet in an exact position to a second cylinder disposed downline of the first cylinder, comprising:

directing at least one airflow onto the sheet lying on the peripheral region of the cylinder;

directing the airflow in a direction of rotation of the cylinder; and directing the airflow onto the sheet from a transfer device.

* * * * *